US009782828B2

(12) United States Patent
Wilkinson

(10) Patent No.: US 9,782,828 B2
(45) Date of Patent: Oct. 10, 2017

(54) METHODS FOR FORMING NEAR NET-SHAPE METAL PARTS FROM BINDERLESS METAL POWDER

(71) Applicant: The Boeing Company, Huntington Beach, CA (US)

(72) Inventor: Carey E. Wilkinson, Summerville, SC (US)

(73) Assignee: The Boeing Company, Chicago, IL (US)

( * ) Notice: Subject to any disclaimer, the term of this patent is extended or adjusted under 35 U.S.C. 154(b) by 247 days.

(21) Appl. No.: 14/518,997

(22) Filed: Oct. 20, 2014

(65) Prior Publication Data

US 2016/0107235 A1 Apr. 21, 2016

(51) Int. Cl.

| | |
|---|---|
| ***B22F 3/02*** | (2006.01) |
| ***B22F 3/093*** | (2006.01) |
| ***B22F 3/04*** | (2006.01) |
| *B22F 1/00* | (2006.01) |

(52) U.S. Cl.

CPC ..... *B22F 3/093* (2013.01); *B22F 1/0003* (2013.01); *B22F 3/02* (2013.01); *B22F 3/04* (2013.01); *B22F 1/0007* (2013.01); *B22F 1/0048* (2013.01); *B22F 2998/10* (2013.01)

(58) Field of Classification Search

None

See application file for complete search history.

(56) References Cited

U.S. PATENT DOCUMENTS

| | | | | |
|---|---|---|---|---|
| 3,165,570 | A | 1/1965 | Deutsch | |
| 3,181,211 | A | 5/1965 | Rearwin | |
| 5,099,650 | A * | 3/1992 | Crunkleton | F25B 9/14 60/520 |
| 5,360,329 | A * | 11/1994 | Lemelson | B21C 23/08 264/328.14 |
| 5,641,920 | A * | 6/1997 | Hens | B22F 1/0059 419/36 |
| 6,187,259 | B1 | 2/2001 | Yamashita et al. | |
| 6,296,044 | B1 | 10/2001 | Brooks et al. | |
| 2002/0011320 | A1 | 1/2002 | Ruhland | |
| 2006/0039817 | A1 * | 2/2006 | Kelly | B22F 3/225 419/32 |
| 2006/0118211 | A1 | 6/2006 | Elliott | |
| 2008/0213611 | A1 | 9/2008 | Asgari | |

(Continued)

*Primary Examiner* — Jessee Roe
*Assistant Examiner* — Ngoclan T Mai
(74) *Attorney, Agent, or Firm* — DASCENZO Intellectual Property Law, P.C.

(57) ABSTRACT

Systems and methods for forming near net-shape metal parts from binderless metal powder are disclosed. Systems include a mold die that defines a die cavity and may include one or more ultrasonic transducers operatively coupled to the mold die. Systems may be configured to introduce binderless metal powder into a die cavity and/or to compact the binderless metal powder within the die cavity. Methods include introducing binderless metal powder into a die cavity of a mold die and compacting the binderless metal powder within the die cavity to form a green part within the die cavity. The binderless metal powder may include spheroidal metal particles and angular metal particles. The methods may further include separating the green part from the mold die and sintering the green part, after separating, to form a sintered near net-shape metal part.

20 Claims, 3 Drawing Sheets

(56) References Cited

U.S. PATENT DOCUMENTS

| | | | | |
|---|---|---|---|---|
| 2009/0129961 | A1* | 5/2009 | Lavoie | B22F 3/225 419/10 |
| 2009/0208360 | A1 | 8/2009 | Wilkinson | |
| 2012/0237385 | A1 | 9/2012 | Wilkinson | |

* cited by examiner

METHODS FOR FORMING NEAR NET-SHAPE METAL PARTS FROM BINDERLESS METAL POWDER

FIELD

The present disclosure relates to systems and methods for forming near net-shape metal parts from binderless metal powder.

BACKGROUND

Powder metallurgy is a process to form near net-shape metal parts from powdered feedstock. The process generally includes forming and/or mixing the powdered metal feedstock, compacting the powder to form a 'green' part (an unsintered part with enough cohesion to be handled), and sintering the compacted powder to metallurgically bond the powder particles together to form the desired part. In some techniques, the compacting and sintering are performed concurrently and no intermediate green part is formed. In the sintering process, the powder (normally in the form of a green part) is heated to a temperature significantly below the melting point of the powder. For example, titanium alloys have a melting point near about 1,700° C. and yet may be sintered at about 900° C.-1,500° C.

A common technique for powder metallurgy is direct die pressing. In this technique, a powder is poured into a die press cavity and then pressed at high pressure with a punch (also called a die press or a tool) to form the green part. The die press cavity has at least one open end configured to fit the punch. The die press cavity has essentially the same lateral dimensions (dimensions perpendicular to the punch action) as the punch. Thus, direct die pressing is essentially limited to simpler parts, often deemed 2.5-dimensional parts (as compared to true three dimensional parts). The lateral shape is rather arbitrary, but the axial shape (the shape in the direction of the punch action) is limited to varying levels, or thicknesses, with no undercuts or overhangs in the axial direction, with a zero to positive draft angle.

An alternate technique that is capable of forming true three dimensional parts is metal injection molding. In metal injection molding, the metal powder is mixed with a significant amount of organic binder to create a feedstock, which is heated to soften and/or melt the binder and then injected under pressure into an enclosed cavity in a manner essentially the same as plastic injection molding. After molding, the green part of metal powder and organic binder is ejected or released from the mold. The green part then is processed to remove most of the organic binder (the de-binding process). The result of the de-binding process is called a 'brown' part. De-binding typically includes chemically dissolving the organic binder and/or heating the green part to melt, vaporize, burn, and/or pyrolyze the organic binder. The final part is formed by sintering the brown part.

The de-binding process may leave organic inclusions in the brown part (where organic binder was trapped and/or incompletely removed). The organic inclusions in the final part may limit the structural integrity and the mechanical properties of the final part.

Additionally, the de-binding process generally results in significant shrinkage of the part. For example, the feedstock may include 30%-40% (by volume) of organic binder. Hence, the green part would include a similar amount of organic binder. The brown part, after de-binding, therefore may have a volume of about 30%-40% less than the green part. The design of the die cavity and the final part needs to account for the significant shrinkage expected to occur during the de-binding process.

One type of metal that is commonly processed with powder metallurgy is titanium alloy. These alloys typically are very strong, light, heat resistant, and corrosion resistant, and find application in a variety of industrial and consumer products. For example, titanium is used extensively in some aircraft for components such as frames, spars, wing boxes, skins, fasteners, engine components (e.g., thrust outlet sheaths, impellers, stators, and bearings), landing gear, doors, air ducting, and floor decking. However, titanium alloys typically are expensive to produce and to process into finished parts. Powder metallurgy is a useful technique for titanium parts but, for example, direct pressing limits the part complexity (and thus its final application) while metal injection molding is a complex process requiring de-binding, any residual binder anomalies result in degraded sintered part integrity.

Therefore, there is a need for improved powder metallurgy techniques that can produce true three dimensional parts and that avoid the limitations of metal injection molding.

SUMMARY

Systems and methods for forming near net-shape metal parts from binderless metal powder are disclosed. Systems include a mold die that defines a die cavity and may include one or more ultrasonic transducers operatively coupled to the mold die. Systems may be configured to introduce binderless metal powder into a die cavity and/or to compact the binderless metal powder within the die cavity. Methods include introducing binderless metal powder into a die cavity of a mold die and compacting the binderless metal powder within the die cavity to form a green part within the die cavity. The binderless metal powder may include spheroidal metal particles and angular metal particles. The methods may further include separating the green part from the mold die and sintering the green part, after separating, to form a sintered near net-shape metal part.

DESCRIPTION

Figure 1:
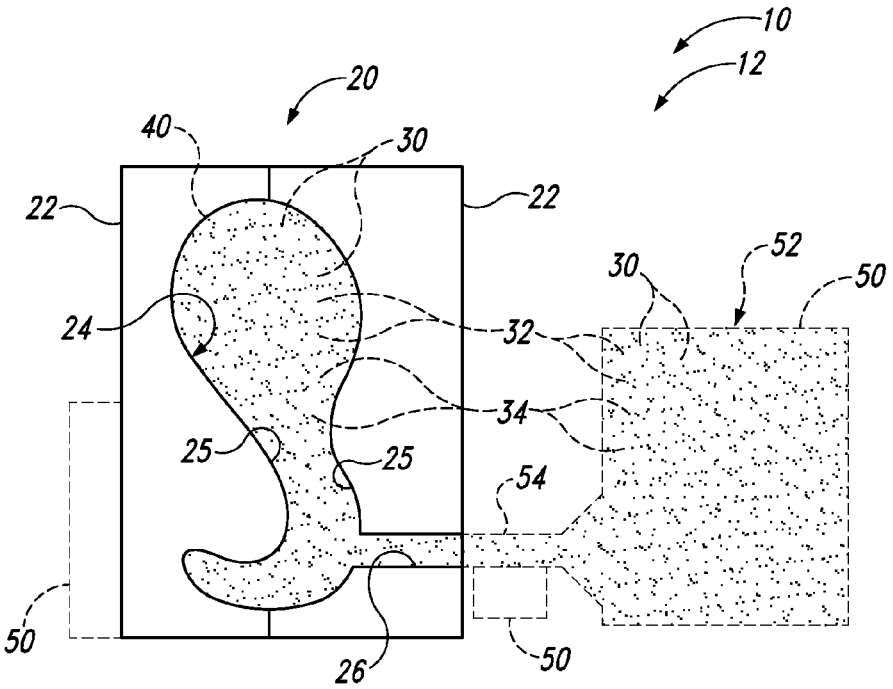
FIG. 1 is a schematic representation of an example of a binderless metal powder molding system.

Systems and methods for forming near net-shape metal parts from binderless metal powder are disclosed herein. In general, in the drawings, elements that are likely to be included in a given embodiment are illustrated in solid lines, while elements that are optional or alternatives are illustrated in dashed lines. However, elements that are illustrated in solid lines are not essential to all embodiments of the present disclosure, and an element shown in solid lines may be omitted from a particular embodiment without departing from the scope of the present disclosure. Elements that serve a similar, or at least substantially similar, purpose are labeled with numbers consistent among the figures. Like numbers in each of the figures, and the corresponding elements, may not be discussed in detail herein with reference to each of the figures. Similarly, all elements may not be labeled in each of the figures, but reference numerals associated therewith may be used for consistency. Elements, components, and/or features that are discussed with reference to one or more of the figures may be included in and/or used with any of the figures without departing from the scope of the present disclosure.

Figure 2:
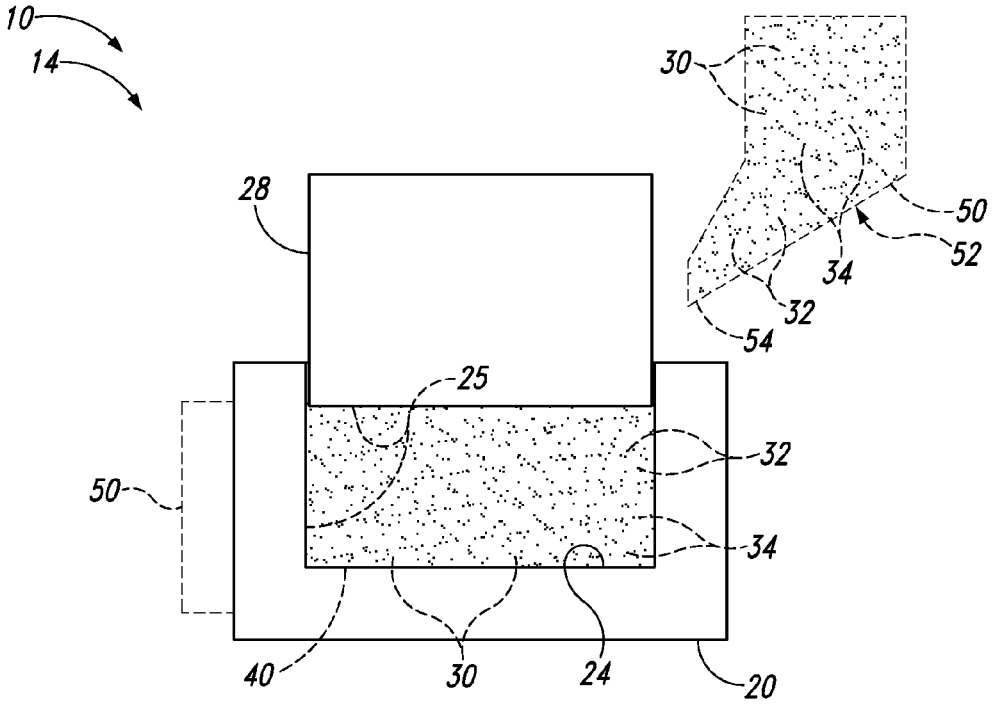
FIG. 2 is a schematic representation of another example of a binderless metal powder molding system.

FIGS. 1 and 2 are schematic representations of examples of binderless metal powder molding systems 10. Systems 10 are configured to produce near net-shape metal parts from metal powder without binders. Systems 10 include a mold die 20 that defines a die cavity 24. Systems 10 are configured to accept a binderless metal powder 30 into the die cavity 24 and to compact the binderless metal powder 30 within the die cavity 24 to form a green part 40. The shape of the green part 40 is substantially defined by the shape of the die cavity 24. Systems 10 may include a metal powder supply device 52 configured to introduce (e.g., to dispense, to transfer, and/or to inject) binderless metal powder 30 into the die cavity 24. The metal powder supply device 52 may include a feed conduit 54 configured to deliver the binderless metal powder 30 into the die cavity 24. Additionally or alternatively, the metal powder supply device 52 may include an ultrasonic transducer 50 configured to encourage flow of the binderless metal powder 30 from the metal powder supply device 52 into the die cavity 24 (e.g., via the feed conduit 54). The ultrasonic transducer 50 may be operatively coupled to the feed conduit 54 and/or another component of the metal powder supply device 52 and may be configured to induce ultrasonic vibrations in the metal powder supply device 52 (and/or a component thereof). Further, systems 10 may include one or more ultrasonic transducers 50 operatively coupled to the mold die 20 and configured to apply ultrasonic energy (in the form of ultrasonic vibrations) to the mold die 20 and/or the binderless metal powder 30 to compact the binderless metal powder 30 into the green part 40 within the mold die 20.

The example system 10 of FIG. 1 is a binderless metal injection molding apparatus 12, which is similar to a metal injection molding apparatus and a plastic injection molding apparatus. The mold die 20 includes at least two die members 22 that collectively define one or more enclosed die cavities 24. An enclosed die cavity 24 is a die cavity 24 that is substantially enclosed by the mold die 20, i.e., essentially all of the shape of the green part 40 is defined by the mold die 20. Die members 22 may include features 25 that are configured to mate in a spaced-apart arrangement to define the die cavity 24 when the die members 22 are coupled together. Each of the features 25 corresponds to a portion of the die cavity 24 and, thus, a portion of the green part 40. Features 25 generally are concavities in the die members 22, though some features 25 may include, and/or may be, convexities, protrusions, projections, ridges, plateaus, etc. Die cavities 24 may only be connected to the outside of the mold die 20 via a sprue 26 (a fill channel) and optional gas vents. Die cavities 24 may be complex die cavities 24 defining true three dimensional parts, e.g., parts with thin walls, ribs, gussets, bosses, undercuts, overhangs, and/or multi-axial curves.

While the binderless metal powder 30 is being introduced into, and compacted within, the die cavity 24, the die members 22 are rigidly coupled together to define the die cavity 24. The apparatus 12, the mold die 20, and/or one or more die members 22 may include pins, locks, and/or clamps configured to selectively retain the die members 22 in a predefined relationship during the introducing and compacting steps. Thus, the apparatus 12, the mold die 20, and/or the die members 22 may be configured to reproducibly create the die cavity 24. Die members 22 may include slides, cores, inserts, and/or sections configured to define one or more portions of the die cavity 24.

After the green part 40 is formed, the die members 22 may separate to release (e.g., by ejecting) the green part 40. For example, one die member 22 may be a fixed die half (also called a cover die half) and another die member 22 may be an ejector die half that is configured to permit removal of the green part 40. At least one die member 22 (e.g., an ejector die half) may include ejector pins to assist removal of the green part 40 from the mold die 20. Additionally or alternatively, die members 22 may be hardened, polished, and/or coated to resist binding of the green part 40 and to assist removal of the green part 40.

Die members 22 may include a sprue 26 configured to permit binderless metal powder 30 to flow from outside the mold die 20 into the die cavity 24, i.e., the sprue 26 is an appropriately sized channel in a die member 22. Die members 22 also may include runners and gates (analogous to plastic injection molding runners and gates) that are configured to distribute binderless metal powder 30 to one or more die cavities 24.

Further description of apparatuses for, and methods of, metal injection molding with binderless metal powder may be found in U.S. Patent Application Publication No. 2012/0237385 (U.S. patent application Ser. No. 13/486,126), entitled "Binderless Metal Injection Molding Apparatus and Method," the complete disclosure of which is herein incorporated by reference for all purposes.

The example system 10 of FIG. 2 is a direct die press apparatus 14, which is similar to a direct die press apparatus. The mold die 20 defines an open die cavity 24. The die cavity 24 has at least one open end (the top end in FIG. 2) configured to accept a mating die press 28 (also referred to as a punch and/or a tool). The apparatus 14 may include a plurality of mating die presses 28 configured to cooperatively press the binderless metal powder 30 through the same open end or through different open ends (e.g., opposite open ends). The shape of the green part 40 is substantially defined by the die cavity 24, the die press(es) 28, and the pressure applied by the apparatus 14 through the die press(es) 28 to the binderless metal powder 30. Die presses 28 and the mold die 20 may include features 25 that are configured to define the shape of the green part 40. Each of the features 25 corresponds to a portion of the die presses 28 and/or the die cavity 24 and, thus, a portion of the green part 40. Features 25 generally are concavities in the die presses 28 and the die cavity 24, though some features 25 may include, and/or may be, convexities, protrusions, projections, ridges, plateaus, etc. The apparatus 14 may be configured to apply a pressure, through at least one of the die presses 28, of greater than 0.2 MPa (megapascals), greater than 0.5 MPa, greater than 1 MPa, greater than 2 MPa, greater than 5 MPa, greater than 10 MPa, greater than 20 MPa, greater than 50 MPa, and/or greater than 100 MPa, less than 1,000 MPa, less than 500 MPa, less than 200 MPa, less than 100 MPa, less than 50 MPa, less than 20 MPa, less than 10 MPa, less than 5 MPa, less than 2 MPa, less than 1 MPa, less than 0.5 MPa, and/or less than 0.2 MPa.

Returning to the general discussion of both FIGS. 1 and 2, systems 10 are configured to form the green part while the binderless metal powder 30 remains in solid form, e.g., at a temperature substantially below the melting point and/or the sintering temperature of the binderless metal powder 30. Systems 10 may be configured to form the green part 40 at ambient conditions (e.g., standard room conditions), elevated temperature, reduced temperature, elevated gas pressure, reduced gas pressure, and/or under at least partial vacuum. The die cavity 24 is generally configured to not apply a mechanical pressure to the binderless metal powder 30. However, the die cavity 24 may react to pressure, force, and/or energy applied by other components of system 10, e.g., the ultrasonic transducer 50, the die press 28, an applied environment, and/or the ambient environment. Suitable temperatures of operation of systems 10, the mold die 20 during operation, and/or the binderless metal powder 30 while in the die cavity 24 include less than 500° C., less than 400° C., less than 300° C., less than 200° C., less than 120° C., less than 100° C., less than 80° C., less than 60° C., less than 40° C., greater than 0° C., greater than 10° C., greater than 20° C., greater than 40° C., greater than 60° C., greater than 80° C., greater than 100° C., and/or greater than 120° C. Suitable pressures of operation of systems 10 and/or applied to the binderless metal powder 30 by a fluid environment include less than 1,000 MPa, less than 500 MPa, less than 200 MPa, less than 100 MPa, less than 50 MPa, less than 20 MPa, less than 10 MPa, less than 5 MPa, less than 2 MPa, less than 1 MPa, less than 0.5 MPa, less than 0.2 MPa, less than 0.1 MPa, less than 0.01 MPa, about 0.1 MPa, greater than 0.1 MPa, greater than 0.2 MPa, greater than 0.5 MPa, greater than 1 MPa, greater than 2 MPa, greater than 5 MPa, greater than 10 MPa, greater than 20 MPa, greater than 50 MPa, and/or greater than 100 MPa. Fluid environments may include, and/or consist essentially of, air, water, hydrogen, nitrogen, and argon.

Binderless metal powders 30 are substantially free of binder (e.g., organic materials, plastics, polymers) and/or include essentially no binder. Binderless metal powders 30 include, and generally consist essentially of, metal particles, for example titanium and/or titanium alloy metal particles. The metal particles may be spheroidal metal particles 32 and/or angular metal particles 34. In particular, mixtures of spheroidal metal particles 32 and angular metal particles 34 may pack tightly and form a dense and/or strong green part 40 with little applied compaction force. Hence, the binderless metal powder 30 may include significant fractions of, and/or consist essentially of, spheroidal metal particles 32 and angular metal particles 34. Spheroidal metal particles 32 have an approximately spherical shape, for example, being spheroidal, spherical, globular, and/or equiaxed, and/or including conglomerations of such shapes. Spheroidal metal particles 32 may be formed by gas atomization, plasma atomization, and/or plasma rotating electrode processing. Angular metal particles 34 have an angular shape, for example, being angulate, polygonal, jagged, broken, sharp, and/or acicular. Angular metal particles 34 may be formed by grinding, crushing, and/or pulverizing. For example, angular titanium particles may be sponge fines (crushed elemental titanium) and/or may be formed by the hydride-dehydride process (heating titanium in the presence of hydrogen, crushing the resulting titanium hydride, and then removing the hydrogen in a vacuum chamber).

The metal particles of the binderless metal powder 30 are relatively small, for example, having an average effective diameter of less than 1,000 μm (micron), less than 500 μm, less than 400 μm, less than 300 μm, less than 200 μm, less than 100 μm, less than 50 μm, less than 20 μm, greater than 10 μm, greater than 20 μm, greater than 50 μm, greater than 100 μm, and/or greater than 200 μm. The average effective diameter of the spheroidal metal particles 32 and the average effective diameter of the angular metal particles 34, when both types are included in a binderless metal powder 30, may be the same or different. For example, the average effective diameter of the angular metal particles 34 may be less than, equal to, about equal to, and/or greater than the average effective diameter of the spheroidal metal particles 32.

Where binderless metal powders 30 include metal particles of different types (such as spheroidal metal particles 32 and angular metal particles 34), the different types may be mixed in the binderless metal powder 30 at a ratio selected for (a) sufficient flow of the binderless metal powder 30 such that the binderless metal powder 30 may be introduced into the die cavity 24 of the system 10, (b) sufficient packing during compaction within the die cavity 24, and/or (c) sufficient green part strength (i.e., sufficient strength to allow the green part 40 to be handled for further processing such as sintering). For example, suitable weight percentages of spheroidal metal particles 32 and/or angular metal particles 34 in the binderless metal powder 30 include at least 1%, at least 2%, at least 5%, at least 10%, at least 15%, at least 20%, at least 30%, at least 40%, at least 50%, at least 60%, at least 70%, at least 80%, at least 85%, at least 90%, at least 95%, at least 98%, at most 99%, at most 98%, at most 95%, at most 90%, at most 85%, at most 80%, at most 70%, at most 60%, at most 50%, at most 40%, at most 30%, at most 20%, at most 15%, at most 10%, at most 5%, and/or at most 2%. As another example, the weight ratio of angular metal particles 34 to spheroidal metal particles 32 in the binderless metal powder 30 may be at most 100, at most 50, at most 20, at most 10, at most 5, at most 2, at most 1, at most 0.5, at most 0.2, at most 0.1, at most 0.05, at most 0.02, at most 0.01, at least 0.01, at least 0.02, at least 0.05, at least 0.1, at least 0.2, at least 0.5, at least 1, at least 2, at least 5, at least 10, at least 20, at least 50, and/or at least 100.

Binderless metal powders 30 may include, and/or consist essentially of, particles of selected metals and/or metal alloys, for example, titanium particles, titanium alloy particles, aluminium particles, aluminium alloy particles, iron particles, iron alloy particles, magnesium, and/or magnesium alloy particles. Further examples of metals and metal alloy components include titanium, aluminium, iron, magnesium, chromium, cobalt, copper, manganese, molybdenum, niobium, nickel, palladium, ruthenium, tin, vanadium, zinc, and/or zirconium. As a more specific example, in the case of a titanium alloy, the metal weight fraction of titanium in the binderless metal powder 30 may be at least 60%, at least 70%, at least 75%, at least 80%, at least 85%, at least 90%, at least 95%, at least 98%, at least 99%, at most 99%, at most 98%, at most 95%, at most 90%, at most 85%, at most 80%, and/or at most 75%. Moreover, a binderless metal powder 30 of a titanium alloy may include titanium and alloying components selected from the group consisting of aluminium, vanadium, chromium, iron, manganese, molybdenum, nickel, niobium, palladium, ruthenium, tin, and zirconium. Each particle of the binderless metal powder 30 may have essentially the same composition or some particles may have differing compositions. For example, a binderless metal powder 30 configured to produce a titanium alloy part may include particles of titanium and particles of alloying metals at the weight percentages of the titanium alloy.

Binderless metal powders 30 may include a liquid lubricant configured to increase the flow of the binderless metal powder 30 into the die cavity 24 and/or to facilitate the distribution of the binderless metal powder 30 within the die cavity 24. The volume fraction of liquid lubricant within the binderless metal powder 30 may be less than 20%, less than 10%, less than 5%, less than 2%, less than 1%, less than 0.5%, less than 0.2%, and/or less than 0.1%.

Figure 3:
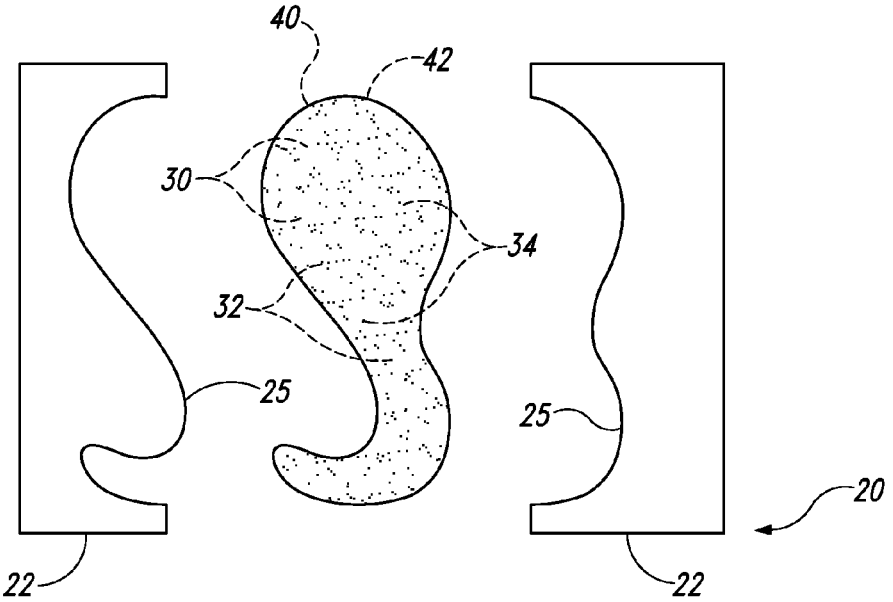
FIG. 3 is a schematic representation of an example of a mold die separated from a corresponding green part formed from binderless metal powder.

As illustrated in FIG. 3, systems 10 may be configured to separate the green part 40 from the die cavity 24 such that new binderless metal powder 30 may be introduced into the die cavity 24 and a new green part 40 formed by compacting the new binderless metal powder 30 in the die cavity 24. Further, systems 10 may be configured to sinter the green parts 40 to form sintered parts 42.

Figure 4:
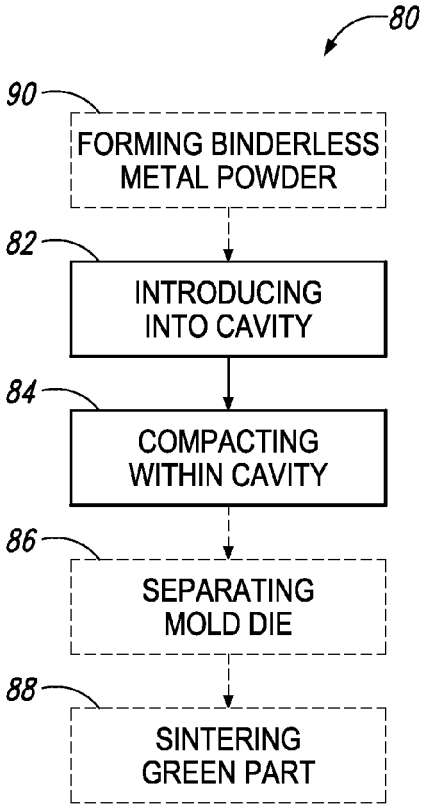
FIG. 4 is a schematic representation of methods of forming a part from binderless metal powder.

FIG. 4 schematically represents methods 80 of forming near net-shape metal parts from binderless metal powder (such as binderless metal powder 30). Methods 80 comprise introducing 82 the binderless metal powder into a die cavity (such as die cavity 24) of a mold die (such a mold die 20) and compacting 84 the binderless metal powder 30 within the die cavity to form a green part (such as green part 40) within the die cavity.

Introducing 82 may include injecting and/or transporting the binderless metal powder 30 into the die cavity, e.g., an enclosed die cavity, and/or filling the die cavity, e.g., an open die cavity, with the binderless metal powder. The injecting, transporting, and/or filling may be achieved and/or facilitated by applying ultrasonic energy to (e.g., inducing ultrasonic vibrations in) the binderless metal powder and/or a metal powder supply device (such as metal powder supply device 52). For example, ultrasonic energy may be applied to the binderless metal powder by inducing ultrasonic vibrations (e.g., by operating an ultrasonic transducer such as ultrasonic transducer 50) in the metal powder supply device (e.g., in the feed tube 54). Additionally or alternatively, introducing 82 may include distributing the binderless metal powder within the die cavity, for example, by applying ultrasonic energy to (e.g., inducing ultrasonic vibrations in) the mold die, one or more die members, the die cavity, and/or the binderless metal powder within the die cavity. Ultrasonic energy may be applied and ultrasonic vibrations may be induced by operating the ultrasonic transducer(s) 50 coupled to the mold die 20 and/or the metal powder supply device 52.

Introducing 82 may be performed at essentially ambient conditions (e.g., standard room conditions), elevated temperature, reduced temperature, elevated gas pressure, reduced gas pressure, and/or under at least partial vacuum. For example, introducing 82 may include heating, cooling, and/or maintaining the temperature of the mold die and/or the binderless metal powder, e.g., to/at a temperature of less than 500° C., less than 400° C., less than 300° C., less than 200° C., less than 120° C., less than 100° C., less than 80° C., less than 60° C., less than 40° C., greater than 0° C., greater than 10° C., greater than 20° C., greater than 40° C., greater than 60° C., greater than 80° C., greater than 100° C., and/or greater than 120° C. As another example, introducing 82 may include applying a mechanical pressure to (e.g., pressing) the binderless metal powder to introduce the binderless metal powder into the die cavity. Additionally or alternatively, introducing 82 may include mixing the binderless metal powder in a transport gas and/or applying pressure to the transport gas including the binderless metal powder to introduce the binderless metal powder into the die cavity. Applying pressure may include applying a vacuum (e.g., applying a vacuum to the die cavity). The pressure applied may be less than 1,000 MPa, less than 500 MPa, less than 200 MPa, less than 100 MPa, less than 50 MPa, less than 20 MPa, less than 10 MPa, less than 5 MPa, less than 2 MPa, less than 1 MPa, less than 0.5 MPa, less than 0.2 MPa, less than 0.1 MPa, less than 0.02 MPa, less than 0.01 MPa, about 0.1 MPa, greater than 0.05 MPa, greater than 0.1 MPa, greater than 0.2 MPa, greater than 0.5 MPa, greater than 1 MPa, greater than 2 MPa, greater than 5 MPa, greater than 10 MPa, greater than 20 MPa, greater than 50 MPa, and/or greater than 100 MPa. Suitable transport gases include, and/or consist essentially of, air, hydrogen, nitrogen, and/or argon.

Introducing 82 may include introducing the binderless metal powder into an enclosed and/or a complex die cavity. For example, introducing 82 may include introducing the binderless metal powder through a sprue (e.g., sprue 26) into the die cavity. Also, where the mold die includes a plurality of die cavities, introducing 82 may include introducing the binderless metal powder into the plurality of die cavities.

Certain binderless metal powders (e.g., titanium powders) may react rapidly with oxygen and/or be explosive. Hence, introducing 82 may include preventing ignition of the binderless metal powder by immersing the binderless metal powder in a shield gas that is inert and/or that includes little to no oxygen. Suitable shield gases include, and/or consist essentially of, hydrogen, nitrogen, and/or argon. The shield gas may be the transport gas.

Compacting 84 may include utilizing ultrasonic energy (e.g., inducing ultrasonic vibrations in the mold die) to cause the binderless metal powder to compact and/or to bind together to form a green part within the die cavity. Additionally or alternatively, compacting 84 may include pressing the binderless metal powder, for example, with a die press (e.g., utilizing the direct die press apparatus 14). Where the compacting 84 includes utilizing ultrasonic energy and pressing, the pressing may be performed before, during, and/or after the application of ultrasonic energy.

Compacting 84 may include applying pressure to the binderless metal powder to form the green part. The pressure applied may be less than 1,000 MPa, less than 500 MPa, less than 200 MPa, less than 100 MPa, less than 50 MPa, less than 20 MPa, less than 10 MPa, less than 5 MPa, less than 2 MPa, less than 1 MPa, less than 0.5 MPa, less than 0.2 MPa, greater than 0.2 MPa, greater than 0.5 MPa, greater than 1 MPa, greater than 2 MPa, greater than 5 MPa, greater than 10 MPa, greater than 20 MPa, greater than 50 MPa, and/or greater than 100 MPa.

Compacting 84 may be performed at essentially ambient conditions (e.g., standard room conditions), elevated temperature, reduced temperature, elevated gas pressure, reduced gas pressure, and/or under at least partial vacuum. For example, compacting 84 may include heating, cooling, and/or maintaining the temperature of the mold die and/or the binderless metal powder, e.g., to/at a temperature of less than 500° C., less than 400° C., less than 300° C., less than 200° C., less than 120° C., less than 100° C., less than 80° C., less than 60° C., less than 40° C., greater than 0° C., greater than 10° C., greater than 20° C., greater than 40° C., greater than 60° C., greater than 80° C., greater than 100° C., and/or greater than 120° C. The gas pressure applied may be less than 1 MPa, less than 0.5 MPa, less than 0.2 MPa, less than 0.1 MPa, less than 0.02 MPa, less than 0.01 MPa, about 0.1 MPa, greater than 0.05 MPa, greater than 0.1 MPa, greater than 0.2 MPa, and/or greater than 0.5 MPa. As with introducing 82, compacting 84 may independently include immersing the binderless metal powder in a shield gas to prevent ignition of the binderless metal powder during compaction.

Compacting 84 may include compacting the binderless metal powder to a green part of high density. For example, the density of the green part may be at least 70%, at least 80%, at least 85%, at least 90%, and/or at least 95% of the density of bulk metal of the same composition as the green part (and the binderless metal powder).

Methods 80 may comprise forming 90 the binderless metal powder. Forming 90 may include mixing different types of metal particles such as spheroidal metal particles (e.g., spheroidal metal particles 32) and angular metal particles (e.g., angular metal particles 34). Metal particles may be of the types, ratios, sizes, and/or compositions described further herein with respect to binderless metal powder 30, spheroidal metal particles 32, and/or angular metal particles 34. Further, forming 90 may include adding liquid lubricant to the spheroidal metal particles, the angular metal particles, and/or the mixture of the particles. The lubricant may be added such that the final volume fraction of the lubricant is less than 20%, less than 10%, less than 5%, less than 2%, less than 1%, less than 0.5%, less than 0.2%, and/or less than 0.1%.

Methods 80 may optionally comprise separating 86 the green part from the mold die. By separating the green part from the mold die, the mold die is available for forming further parts and the green part may be further processed. The green part is sufficiently compacted by the compacting 84 to have enough structural integrity to be handled for further processing, i.e., the binderless metal powder particles in the green part are sufficiently adhered to form a unified part. Generally, the metal particles of the green part are held together by powder packing cohesion (e.g., cold welds) between the metal particles.

Methods 80 may optionally comprise sintering 88 the green part to form a sintered part (e.g., sintered part 42). Sintering 88 may be performed before or after the optional separating 86. Sintering 88 is a process of fusing the metal particles (metallurgically bonding the particles together) in the green part by heating, without melting the metal particles. Sintering 88 generally is a solid phase process which includes raising the temperature of the green part to a temperature sufficient to allow the metal particles of the green part to fuse together and/or coalesce. The sintering temperature is significantly less than the melting temperature of the metal particles. For example, sintering 88 may include heating the green part to, and/or maintaining the green part at, a temperature of greater than 500° C., greater than 800° C., greater than 1,000° C., greater than 1,200° C., greater than 1,400° C., greater than 1,600° C., greater than 1,800° C., greater than 2,000° C. less than 2,500° C., less than 2,000° C., less than 1,800° C., less than 1,600° C., less than 1,400° C., less than 1,200° C., less than 1,000° C., and/or less than 800° C.

The green part may be relatively compact; however, sintering 88 generally makes the green part denser as it becomes the sintered part. For example, though the sintered part has essentially the same mass as the green part, the sintered part may have a volume of at least 80%, at least 90%, at least 95%, at least 98%, and/or at least 99% of a volume of the green part. The density of the sintered part may be at least 80%, at least 85%, at least 90%, at least 95%, at least 98%, and/or at least 99% of the density of bulk metal of the same composition as the sintered part (and the binderless metal powder).

Sintering 88 may include preparatory processes to remove and/or reduce gas, liquids, and/or solids trapped between the metal particles of the green part. For example, sintering 88 may include heating to evaporate, to burn, and/or to pyrolyze liquid lubricant used in the introducing 82 and/or the compacting 84.

Methods 80 (e.g., forming 90, introducing 82, compacting 84, and/or sintering 88) may be adapted to avoid organic inclusions in the resulting green part. Because the binderless metal powder includes little to no organic material (in particular, essentially no binder), the resulting green parts and/or sintered parts include substantially no organic inclusion and/or may be entirely free of organic inclusions. In contrast, metal injection molding (utilizing binder and metal powder mixtures) may result in 30%-40% (by volume) of the green part being organic material (the binder). Moreover, methods 80 may be adapted to produce green parts and/or sintered parts with little carbon and/or oxygen. For example, the resulting green part and/or sintered part may include carbon at a weight percentage of less than 10%, less than 5%, less than 2%, less than 1%, less than 0.5%, less than 0.2%, less than 0.1%, and/or less than 0.05%. As another example, the resulting green part and/or sintered part may include oxygen at a weight percentage of less than 2%, less than 1%, less than 0.5%, less than 0.2%, and/or less than 0.1%.

Prior to, during and/or after sintering 88, methods 80 may include other operations such as cold isostatic pressing, hot isostatic pressing, heat treating, forging, and/or machining to create a final part. In hot or cold isostatic pressing, the green part is compacted by fluid pressure. Cold isostatic pressing typically utilizes fluid pressure to compact a green part or a sintered part, without heating the part. Hot isostatic pressing typically utilizes gas pressure to compact a green part or a sintered part, while heating the part. Hot isostatic pressing may include heating sufficient to sinter the part.

Figure 5:
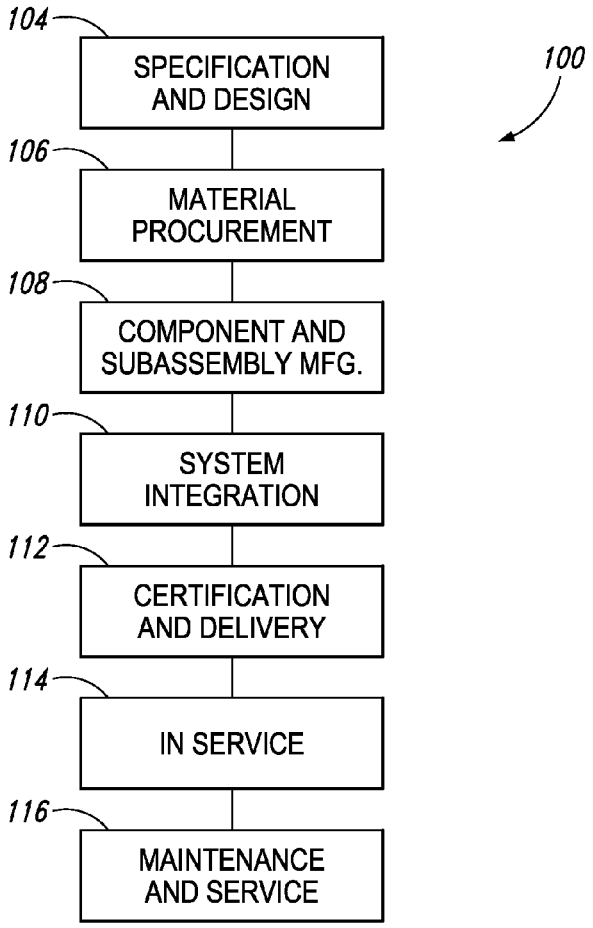
FIG. 5 is a flow diagram of an aircraft production and service methodology.
Figure 6:
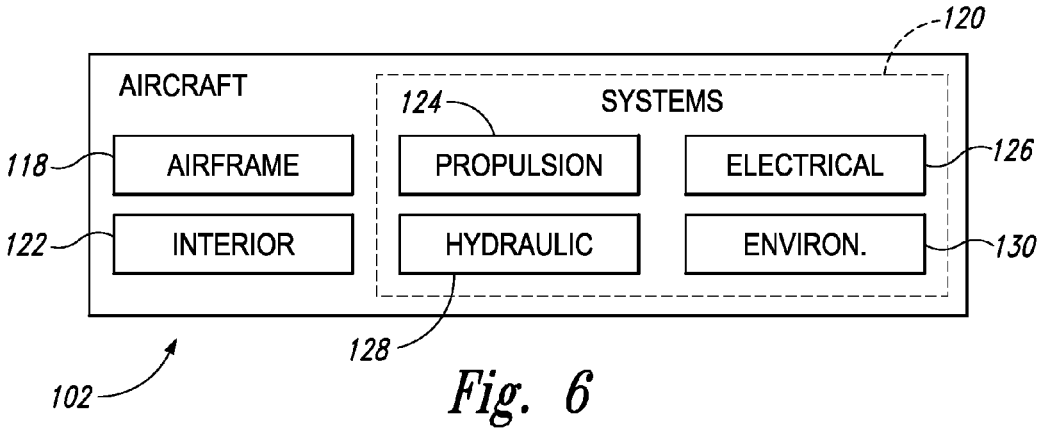
FIG. 6 is a block diagram of an aircraft.

Devices and methods of the present disclosure may be described in the context of an aircraft manufacturing and service method 100 as shown in FIG. 5 and an aircraft 102 as shown in FIG. 6. During pre-production, exemplary method 100 may include specification and design 104 of the aircraft 102 and material procurement 106. During production, component and subassembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116 (which may also include modification, reconfiguration, refurbishment, and so on).

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 6, the aircraft 102 produced by exemplary method 100 may include an airframe 118 with a plurality of systems 120 and an interior 122. Examples of high-level systems 120 include one or more of a propulsion system 124, an electrical system 126, a hydraulic system 128, and an environmental system 130. Any number of other systems may be included. Although an aerospace example is shown, the principles of the invention may be applied to other industries, such as the automotive industry.

Apparatus and methods embodied herein may be employed during any one or more of the stages of the production and service method 100. For example, components or subassemblies corresponding to production process 108 may be fabricated or manufactured in a manner similar to components or subassemblies produced while the aircraft 102 is in service. Also, one or more apparatus embodiments, method embodiments, or a combination thereof may be utilized during the production stages 108 and 110, for example, by substantially expediting assembly of or reducing the cost of an aircraft 102. Similarly, one or more of apparatus embodiments, method embodiments, or a combination thereof may be utilized while the aircraft 102 is in service, for example and without limitation, to maintenance and service 116.

Examples of inventive subject matter according to the present disclosure are described in the following enumerated paragraphs.

A1. A method for forming a near net-shape metal part, the method comprising:

introducing binderless metal powder into a die cavity of a mold die; and compacting the binderless metal powder within the die cavity to form a green part within the die cavity.

A2. The method of paragraph A1, wherein the binderless metal powder includes, and/or consists essentially of, metal particles, spheroidal metal particles, and/or angular metal particles.

A2.1. The method of paragraph A2, wherein the metal particles, the spheroidal metal particles, and/or the angular metal particles have an average effective diameter of less than 1,000 μm, less than 500 μm, less than 400 μm, less than 300 μm, less than 200 μm, less than 100 μm, less than 50 μm, less than 20 μm, greater than 10 μm, greater than 20 μm, greater than 50 μm, greater than 100 μm, and/or greater than 200 μm.

A2.2. The method of any of paragraphs A2-A2.1, wherein the angular metal particles have an average effective diameter of less than, equal to, about equal to, and/or greater than an average effective diameter of the spheroidal metal particles.

A2.3. The method of any of paragraphs A2-A2.2, wherein the binderless metal powder includes a weight percent of angular metal particles of at least 1%, at least 2%, at least 5%, at least 10%, at least 15%, at least 20%, at least 30%, at least 40%, at least 50%, at least 60%, at least 70%, at least 80%, at least 85%, at least 90%, at least 95%, at least 98%, at most 99%, at most 98%, at most 95%, at most 90%, at most 85%, at most 80%, at most 70%, at most 60%, at most 50%, at most 40%, at most 30%, at most 20%, at most 15%, at most 10%, at most 5%, and/or at most 2%.

A2.4. The method of any of paragraphs A2-A2.3, wherein the binderless metal powder includes a weight percent of spheroidal metal particles of at least 1%, at least 2%, at least 5%, at least 10%, at least 15%, at least 20%, at least 30%, at least 40%, at least 50%, at least 60%, at least 70%, at least 80%, at least 85%, at least 90%, at least 95%, at least 98%, at most 99%, at most 98%, at most 95%, at most 90%, at most 85%, at most 80%, at most 70%, at most 60%, at most 50%, at most 40%, at most 30%, at most 20%, at most 15%, at most 10%, at most 5%, and/or at most 2%.

A2.5. The method of any of paragraphs A2-A2.4, wherein the binderless metal powder includes, and/or consists essentially of, at least one of titanium particles, titanium alloy particles, aluminium particles, aluminium alloy particles, iron particles, iron alloy particles, magnesium, and magnesium alloy particles.

A3. The method of any of paragraphs A1-A2.5, wherein the binderless metal powder includes, and/or or consists essentially of, at least one of titanium, aluminium, iron, magnesium, chromium, cobalt, copper, manganese, molybdenum, niobium, nickel, palladium, ruthenium, tin, vanadium, zinc, and zirconium.

A4. The method of any of paragraphs A1-A3, wherein the binderless metal powder has a metal weight fraction of titanium of at least 60%, at least 70%, at least 75%, at least 80%, at least 85%, at least 90%, at least 95%, at least 98%, at least 99%, at most 99%, at most 98%, at most 95%, at most 90%, at most 85%, at most 80%, and/or at most 75%.

A5. The method of any of paragraphs A1-A4, wherein the binderless metal powder has a metal fraction that includes titanium and alloying components selected from the group consisting of aluminium, vanadium, chromium, iron, manganese, molybdenum, nickel, niobium, palladium, ruthenium, tin, and zirconium.

A6. The method of any of paragraphs A1-A5, wherein the binderless metal powder includes a liquid lubricant.

A6.1. The method of paragraph A6, wherein the binderless metal powder has a volume fraction of liquid lubricant of less than 20%, less than 10%, less than 5%, less than 2%, less than 1%, less than 0.5%, less than 0.2%, and/or less than 0.1%.

A7. The method of any of paragraphs A1-A6.1, further comprising forming the binderless metal powder by mixing angular metal particles with spheroidal metal particles.

A7.1. The method of paragraph A7, wherein the angular metal particles and/or the spheroidal metal particles have an average effective diameter of less than 1,000 μm, less than 500 μm, less than 400 μm, less than 300 μm, less than 200 μm, less than 100 μm, less than 50 μm, less than 20 μm, greater than 10 μm, greater than 20 μm, greater than 50 μm, greater than 100 μm, and/or greater than 200 μm.

A7.2. The method of any of paragraphs A7-A7.1, wherein the angular metal particles have an average effective diameter of less than, equal to, about equal to, and/or greater than an average effective diameter of the spheroidal metal particles.

A7.3. The method of any of paragraphs A7-A7.2, wherein the angular metal particles and/or the spheroidal metal particles include, and/or consist essentially of, at least one of titanium particles, titanium alloy particles, aluminium particles, aluminium alloy particles, iron particles, iron alloy particles, magnesium, and magnesium alloy particles.

A7.4. The method of any of paragraphs A7-A7.3, wherein the binderless metal powder includes a weight percent of angular metal particles of at least 1%, at least 2%, at least 5%, at least 10%, at least 15%, at least 20%, at least 30%, at least 40%, at least 50%, at least 60%, at least 70%, at least 80%, at least 85%, at least 90%, at least 95%, at least 98%, at most 99%, at most 98%, at most 95%, at most 90%, at most 85%, at most 80%, at most 70%, at most 60%, at most 50%, at most 40%, at most 30%, at most 20%, at most 15%, at most 10%, at most 5%, and/or at most 2%.

A7.5. The method of any of paragraphs A7-A7.4, wherein the binderless metal powder includes a weight percent of spheroidal metal particles of at least 1%, at least 2%, at least 5%, at least 10%, at least 15%, at least 20%, at least 30%, at least 40%, at least 50%, at least 60%, at least 70%, at least 80%, at least 85%, at least 90%, at least 95%, at least 98%, at most 99%, at most 98%, at most 95%, at most 90%, at most 85%, at most 80%, at most 70%, at most 60%, at most 50%, at most 40%, at most 30%, at most 20%, at most 15%, at most 10%, at most 5%, and/or at most 2%.

A7.6. The method of any of paragraphs A7-A7.5, wherein the forming includes adding liquid lubricant to the angular metal particles and/or the spheroidal metal particles to form a binderless metal powder with liquid lubricant, optionally at a volume fraction of less than 20%, less than 10%, less than 5%, less than 2%, less than 1%, less than 0.5%, less than 0.2%, and/or less than 0.1%.

A8. The method of any of paragraphs A1-A7.6, wherein the introducing includes injecting the binderless metal powder into the die cavity.

A9. The method of any of paragraphs A1-A8, wherein the introducing includes filling the die cavity with the binderless metal powder.

A10. The method of any of paragraphs A1-A9, wherein the introducing includes introducing the binderless metal powder into the die cavity with a pressure of less than 1,000 MPa, less than 500 MPa, less than 200 MPa, less than 100 MPa, less than 50 MPa, less than 20 MPa, less than 10 MPa, less than 5 MPa, less than 2 MPa, less than 1 MPa, less than 0.5 MPa, less than 0.2 MPa, less than 0.1 MPa, less than 0.02 MPa, less than 0.01 MPa, about 0.1 MPa, greater than 0.05 MPa, greater than 0.1 MPa, greater than 0.2 MPa, greater than 0.5 MPa, greater than 1 MPa, greater than 2 MPa, greater than 5 MPa, greater than 10 MPa, greater than 20 MPa, greater than 50 MPa, and/or greater than 100 MPa.

A11. The method of any of paragraphs A1-A10, wherein the introducing includes mixing the binderless metal powder in a transport gas and applying pressure to the transport gas that includes the binderless metal powder, optionally wherein the transport gas includes, and/or consists essentially of, air, hydrogen, nitrogen, and/or argon.

A12. The method of any of paragraphs A1-A11, wherein the introducing includes immersing the binderless metal powder in an inert shield gas, optionally wherein the inert shield gas includes, and/or consists essentially of, hydrogen, nitrogen, and/or argon.

A13. The method of any of paragraphs A1-A12, wherein the introducing includes transporting the binderless metal powder into the die cavity with ultrasonic energy.

A14. The method of any of paragraphs A1-A13, wherein the introducing includes distributing the binderless metal powder within the die cavity with ultrasonic energy.

A15. The method of any of paragraphs A1-A14, wherein the introducing includes inducing ultrasonic vibrations in the mold die to distribute the binderless metal powder within the die cavity.

A16. The method of any of paragraphs A1-A15, wherein the compacting includes inducing ultrasonic vibrations in the mold die.

A17. The method of any of paragraphs A1-A16, wherein the compacting includes compacting with ultrasonic energy.

A18. The method of any of paragraphs A1-A17, wherein the compacting includes compacting the binderless metal powder within the die cavity by inducing ultrasonic vibrations in the mold die to form a green part within the die cavity.

A19. The method of any of paragraphs A1-A18, wherein the compacting includes pressing the binderless metal powder.

A19.1. The method of paragraph A19, wherein the pressing is pressing with a die press, a tool, and/or a punch.

A19.2. The method of any of paragraphs A19-A19.1, when also dependent on paragraph A18, wherein the pressing is performed before, during, and/or after the inducing.

A20. The method of any of paragraphs A1-A19.2, wherein the compacting includes compacting the binderless metal powder with a pressure of less than 1,000 MPa, less than 500 MPa, less than 200 MPa, less than 100 MPa, less than 50 MPa, less than 20 MPa, less than 10 MPa, less than 5 MPa, less than 2 MPa, less than 1 MPa, less than 0.5 MPa, less than 0.2 MPa, greater than 0.2 MPa, greater than 0.5 MPa, greater than 1 MPa, greater than 2 MPa, greater than 5 MPa, greater than 10 MPa, greater than 20 MPa, greater than 50 MPa, and/or greater than 100 MPa.

A21. The method of any of paragraphs A1-A20, wherein the compacting includes immersing the binderless metal powder in an inert shield gas.

A21.1. The method of paragraph A21, wherein the inert shield gas includes, optionally consists essentially of, at least one of hydrogen, nitrogen, and argon.

A22. The method of any of paragraphs A1-A21.1, wherein the compacting includes compacting the binderless metal powder to a density of at least 70%, at least 80%, at least 85%, at least 90%, and/or at least 95% of a density of a bulk metal formed from the metal powder.

A23. The method of any of paragraphs A1-A22, further comprising maintaining, during the introducing and/or the compacting, a temperature of the mold die and/or a temperature of the binderless metal powder at less than 500° C., less than 400° C., less than 300° C., less than 200° C., less than 120° C., less than 100° C., less than 80° C., less than 60° C., less than 40° C., greater than 0° C., greater than 10° C., greater than 20° C., greater than 40° C., greater than 60° C., greater than 80° C., greater than 100° C., and/or greater than 120° C.

A24. The method of any of paragraphs A1-A23, wherein the green part has substantially no organic inclusions and/or is free of organic inclusions.

A25. The method of any of paragraphs A1-A24, wherein the green part has a weight percentage of carbon of less than 10%, less than 5%, less than 2%, less than 1%, less than 0.5%, less than 0.2%, less than 0.1%, and/or less than 0.05%.

A26. The method of any of paragraphs A1-A25, wherein the green part has a weight percentage of oxygen of less than 2%, less than 1%, less than 0.5%, less than 0.2%, and/or less than 0.1%.

A27. The method of any of paragraphs A1-A26, further comprising separating the green part from the mold die.

A28. The method of any of paragraphs A1-A27, further comprising sintering the green part to form a sintered near net-shape metal part.

A28.1. The method of paragraph A28, when also dependent on paragraph A27, wherein the sintering is performed after the separating.

A28.2. The method of any of paragraphs A28-A28.1, wherein the near net-shape metal part is the sintered near net-shape metal part.

A28.3. The method of any of paragraphs A28-A28.2, wherein the sintered near net-shape metal part has substantially no organic inclusions and/or is free of organic inclusions.

A28.4. The method of any of paragraphs A28-A28.3, wherein the sintered near net-shape metal part has a weight percentage of carbon of less than 10%, less than 5%, less than 2%, less than 1%, less than 0.5%, less than 0.2%, less than 0.1%, and/or less than 0.05%.

A28.5. The method of any of paragraphs A28-A28.4, wherein the sintered near net-shape metal part has a weight percentage of oxygen of less than 2%, less than 1%, less than 0.5%, less than 0.2%, and/or less than 0.1%.

A28.6. The method of any of paragraphs A28-A28.5, wherein the sintered near net-shape metal part has a volume of at least 80%, at least 90%, at least 95%, at least 98%, and/or at least 99% of a volume of the green part.

A28.7. The method of any of paragraphs A28-A28.6, wherein the sintered near net-shape metal part has a density of at least 80%, at least 85%, at least 90%, at least 95%, at least 98%, and/or at least 99% of a density of a bulk metal formed from the binderless metal powder.

A28.8. The method of any of paragraphs A28-A28.7, wherein the sintering includes heating the green part to, and/or maintaining the green part at, a temperature of greater than 500° C., greater than 800° C., greater than 1,000° C., greater than 1,200° C., greater than 1,400° C., greater than 1,600° C., greater than 1,800° C., greater than 2,000° C., less than 2,500° C., less than 2,000° C., less than 1,800° C., less than 1,600° C., less than 1,400° C., less than 1,200° C., less than 1,000° C., and/or less than 800° C.

A29. The method of any of paragraphs A1-A28.8, further comprising isostatic pressing the green part.

A29.1. The method of paragraph A29, when also dependent on paragraph A27, wherein the isostatic pressing is performed after the separating.

A29.2. The method of any of paragraphs A29-A29.1, wherein the isostatic pressing is performed during and/or after the compacting.

A29.3. The method of any of paragraphs A29-A29.2, wherein the isostatic pressing includes at least one of cold isostatic pressing and hot isostatic pressing.

A30. The method of any of paragraphs A1-A29.3, wherein the mold die defines a sprue configured to introduce material into the die cavity and wherein the introducing includes introducing the binderless metal powder through the sprue into the die cavity.

A31. The method of any of paragraphs A1-A30, wherein the mold die includes a plurality of die cavities and wherein the introducing includes introducing the binderless metal powder into the plurality of die cavities.

A32. The method of any of paragraphs A1-A31, wherein the die cavity is substantially enclosed by the mold die.

A33. The method of any of paragraphs A1-A32, wherein the die cavity is a complex die cavity, optionally defining at least one thin wall, rib, gusset, boss, undercut, overhang, and multi-axial curve.

A34. The method of any of paragraphs A1-A33, wherein the green part includes at least one thin wall, rib, gusset, boss, undercut, overhang, and multi-axial curved surface.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function. Further, as used herein, the singular forms "a", "an" and "the" may be intended to include the plural forms as well, unless the context clearly indicates otherwise.

The various disclosed elements of apparatuses and steps of methods disclosed herein are not required of all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

In the event that any patents or patent applications are incorporated by reference herein and (1) define a term in a manner and/or (2) are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

The invention claimed is:

1. A method for forming a near net-shape metal part, the method comprising:

introducing binderless metal powder into a die cavity; and compacting the binderless metal powder within the die cavity to form a green part within the die cavity;

wherein the binderless metal powder includes spheroidal metal particles and angular metal particles, and wherein a weight percentage of the angular metal particles in the binderless metal powder is greater than 50%.

2. The method of claim 1, wherein the spheroidal metal particles consist essentially of at least one of titanium particles and titanium alloy particles, and wherein the angular metal particles consist essentially of at least one of titanium particles and titanium alloy particles.

3. The method of claim 1, wherein the introducing includes distributing the binderless metal powder within the die cavity with ultrasonic energy.

4. The method of claim 1, wherein the compacting includes compacting with ultrasonic energy.

5. The method of claim 1, further comprising isostatic pressing the green part.

6. The method of claim 1, wherein the introducing and the compacting are performed to form the green part with a weight percentage of carbon of less than 5%.

7. The method of claim 1, wherein the introducing and the compacting are performed to form the green part with a weight percentage of oxygen of less than 1%.

8. The method of claim 1, further comprising sintering the green part to form the near net-shape metal part.

9. The method of claim 8, wherein the near net-shape metal part after the sintering has a volume at least 80% of a volume of the green part.

10. The method of claim 8, wherein the near net-shape metal part after the sintering has a density of at least 90% of a density of a bulk metal formed from the binderless metal powder.

11. The method of claim 1, wherein the die cavity is defined by a mold die that defines a sprue configured to introduce material into the die cavity and wherein the introducing includes introducing the binderless metal powder through the sprue into the die cavity.

12. A method for forming a sintered near net-shape metal part, the method comprising:

introducing binderless metal powder into a die cavity of a mold die;

compacting the binderless metal powder within the die cavity by inducing ultrasonic vibrations in the mold die to form a green part within the die cavity;

separating the green part from the mold die; and sintering, after the separating, the green part to form the sintered near net-shape metal part;

wherein the binderless metal powder includes spheroidal metal particles and angular metal particles, and wherein a weight percentage of the angular metal particles in the binderless metal powder is greater than 50%.

13. The method of claim 12, further comprising maintaining, during the introducing and the compacting, a temperature of the binderless metal powder at less than 80° C.

14. The method of claim 12, wherein the compacting includes compacting the binderless metal powder with a pressure of less than 0.5 MPa.

15. The method of claim 12, wherein the introducing includes distributing the binderless metal powder within the die cavity with ultrasonic energy.

16. The method of claim 12, wherein the introducing includes filling the die cavity with the binderless metal powder.

17. The method of claim 12, wherein the mold die defines a sprue configured to introduce material into the die cavity and wherein the introducing includes introducing the binderless metal powder through the sprue into the die cavity.

18. The method of claim 12, wherein the binderless metal powder has a metal weight fraction of titanium of at least 80%.

19. The method of claim 1, wherein the angular metal particles have an average effective diameter that is greater than an average effective diameter of the spheroidal metal particles.

20. The method of claim 12, wherein the angular metal particles have an average effective diameter that is greater than an average effective diameter of the spheroidal metal particles.

* * * * *